US009074773B2

(12) United States Patent
Boardman et al.

(10) Patent No.: US 9,074,773 B2
(45) Date of Patent: Jul. 7, 2015

(54) COMBUSTOR ASSEMBLY WITH TRAPPED VORTEX CAVITY

(75) Inventors: Gregory Allen Boardman, Greenville, SC (US); Ronald Chila, Greenfield Center, NY (US); Johnie F. McConnaughhay, Greenville, SC (US)

(73) Assignee: General Electric Company, Schenectady, NY (US)

( * ) Notice: Subject to any disclaimer, the term of this patent is extended or adjusted under 35 U.S.C. 154(b) by 740 days.

(21) Appl. No.: 13/367,686

(22) Filed: Feb. 7, 2012

(65) Prior Publication Data

US 2013/0199188 A1 Aug. 8, 2013

(51) Int. Cl.

| | |
|---|---|
| ***F23R 3/30*** | (2006.01) |
| ***F23R 3/28*** | (2006.01) |
| *F23R 3/58* | (2006.01) |
| *F23C 5/00* | (2006.01) |

(52) U.S. Cl.

CPC ..... *F23R 3/286* (2013.01); *F23R 2900/00015* (2013.01)

(58) Field of Classification Search

CPC ..... F23R 2900/0015; F23R 3/30; F23R 3/58; F23R 3/286; F23C 5/00

USPC ..... 60/722, 737, 750, 239, 39.463, 749, 60/746; 431/8, 9, 354

See application file for complete search history.

(56) References Cited

U.S. PATENT DOCUMENTS

| | | | | |
|---|---|---|---|---|
| 5,619,855 | A * | 4/1997 | Burrus | 60/736 |
| 5,791,148 | A * | 8/1998 | Burrus | 60/752 |
| 6,295,801 | B1 * | 10/2001 | Burrus et al. | 60/776 |
| 6,481,209 | B1 * | 11/2002 | Johnson et al. | 60/746 |
| 6,735,949 | B1 * | 5/2004 | Haynes et al. | 60/746 |
| 6,951,108 | B2 | 10/2005 | Burrus | |
| 7,003,961 | B2 | 2/2006 | Kendrick | |
| 8,272,219 | B1 * | 9/2012 | Johnson et al. | 60/746 |
| 2002/0112482 | A1 * | 8/2002 | Johnson et al. | 60/776 |
| 2003/0141388 | A1 * | 7/2003 | Johnson et al. | 239/550 |
| 2004/0020211 | A1 * | 2/2004 | Kendrick et al. | 60/750 |
| 2004/0103663 | A1 * | 6/2004 | Haynes et al. | 60/737 |
| 2005/0034458 | A1 * | 2/2005 | Burrus et al. | 60/750 |
| 2006/0107667 | A1 * | 5/2006 | Haynes et al. | 60/776 |
| 2007/0044476 | A1 * | 3/2007 | Koshoffer | 60/776 |

(Continued)

FOREIGN PATENT DOCUMENTS

| | | | |
|---|---|---|---|
| EP | 1371906 | A2 | 12/2003 |
| EP | 1659338 | A1 | 5/2006 |

OTHER PUBLICATIONS

Search Report from EP Application No. 13153606.2 dated Aug. 9, 2013.

*Primary Examiner* — Phutthiwat Wongwian
*Assistant Examiner* — Eric Linderman
(74) *Attorney, Agent, or Firm* — Sutherland Asbill & Brennan LLP

(57) ABSTRACT

A combustor assembly is disclosed. The combustor assembly may include an annular trapped vortex cavity located adjacent to a downstream end of a bundle of air/fuel premixing injection tubes. The annular trapped vortex cavity may include an opening at a radially inner portion of the annular trapped vortex cavity adjacent to the head end of the bundle of premixing tubes. The annular trapped vortex cavity may also include one or more air injection holes and one or more fuel sources disposed about the annular trapped vortex cavity such that the one or more air injection holes and the one or more fuel sources are configured to drive a vortex within the annular trapped vortex cavity.

13 Claims, 5 Drawing Sheets

(56) References Cited

U.S. PATENT DOCUMENTS

| | | | | |
|---|---|---|---|---|
| 2008/0019822 | A1* | 1/2008 | Grammel et al. | 415/115 |
| 2008/0134684 | A1* | 6/2008 | Umeh et al. | 60/772 |
| 2008/0271703 | A1* | 11/2008 | Armstrong et al. | 123/263 |
| 2009/0056340 | A1* | 3/2009 | Woltmann et al. | 60/765 |
| 2011/0061392 | A1* | 3/2011 | Kendrick | 60/737 |
| 2011/0061395 | A1* | 3/2011 | Kendrick | 60/772 |
| 2011/0185735 | A1* | 8/2011 | Snyder | 60/746 |
| 2013/0318992 | A1* | 12/2013 | Carnell et al. | 60/776 |

* cited by examiner

COMBUSTOR ASSEMBLY WITH TRAPPED VORTEX CAVITY

FIELD OF THE INVENTION

Embodiments of the present application relate generally to gas turbine engines and more particularly to combustor assemblies including a trapped vortex cavity.

BACKGROUND OF THE INVENTION

Gas turbine efficiency generally increases with the temperature of the combustion gas stream. Higher combustion gas stream temperatures, however, may produce higher levels of undesirable emissions such as nitrogen oxides (NOx) and the like. NOx emissions generally are subject to governmental regulations. Improved gas turbine efficiency therefore must be balanced with compliance with emissions regulations.

Lower NOx emission levels may be achieved by providing for good mixing of the fuel stream and the air stream. For example, the fuel stream and the air stream may be premixed in a Dry Low NOx (DLN) combustor before being admitted to a reaction or a combustion zone. Such premixing tends to reduce combustion temperatures and NOx emissions output.

The fuel stream and the air stream are generally premixed in tightly packed bundles of air/fuel premixing tubes to form axial jets in the combustion chamber. The tightly packed bundles of air/fuel premixed axial jets may suffer from blow-off or instability at low-load or part-speed conditions. Accordingly, what is needed is a system that provides reliable, robust ignition and cross-firing, more efficient part-speed and non-loaded operation, and overall improved combustion stability and increased operability when using a DLN combustor having micromixer air/fuel premixing tube bundles.

BRIEF DESCRIPTION OF THE INVENTION

Some or all of the above needs and/or problems may be addressed by certain embodiments of the present application. According to one embodiment, there is disclosed a combustor assembly. The combustor assembly may include an annular trapped vortex cavity located adjacent to a downstream end of a bundle of air/fuel premixing injection tubes. The annular trapped vortex cavity may include an opening at a radially inner portion of the annular trapped vortex cavity adjacent to the head end of the bundle of premixing tubes. The annular trapped vortex cavity may also include one or more air injection holes and one or more fuel sources disposed about the annular trapped vortex cavity such that the one or more air injection holes and the one or more fuel sources are configured to drive a vortex within the annular trapped vortex cavity.

According to another embodiment, there is disclosed a combustor assembly. The combustor assembly may include a bundle of air/fuel premixing injection tubes having an upstream end, a downstream end, and a flow path therebetween. An annular trapped vortex cavity may be located adjacent to the downstream end of the air/fuel premixing injection tubes. The annular trapped vortex cavity may include an annular aft wall, an annular forward wall, and an annular radially outer wall formed therebetween. The annular trapped vortex cavity may also include an opening at a radially inner portion of the annular trapped vortex cavity spaced apart from the outer wall and extending between the aft wall and the forward wall. One or more air injection holes and one or more fuel sources may be disposed about the annular trapped vortex cavity such that the one or more air injection holes and the one or more fuel sources are configured to drive a vortex within the annular trapped vortex cavity.

Further, according to another embodiment, there is disclosed a combustor assembly. The combustor assembly may include a bundle of air/fuel premixing injection tubes having an upstream end, a downstream end, and a flow path therebetween. An annular trapped vortex cavity may be located adjacent to the downstream end of the air/fuel premixing injection tubes. The annular trapped vortex cavity may include an annular aft wall, an annular forward wall, and an annular radially outer wall formed therebetween. The annular trapped vortex cavity may also include an opening at a radially inner portion of the annular trapped vortex cavity spaced apart from the outer wall and extending between the aft wall and the forward wall. One or more air injection holes and one or more fuel sources may be disposed about the annular trapped vortex cavity such that the one or more air injection holes and the one or more fuel sources are configured to drive a vortex within the annular trapped vortex cavity. Moreover, the combustor assembly may include a combustion chamber surrounded by an annular combustor liner disposed in air flow communication with the bundle of premixing tubes, the annular trapped vortex cavity, the one or more air injection holes, and the one or more fuel sources.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE INVENTION

Illustrative embodiments will now be described more fully hereinafter with reference to the accompanying drawings, in which some, but not all embodiments are shown. The present application may be embodied in many different forms and should not be construed as limited to the embodiments set forth herein. Like numbers refer to like elements throughout.

Figure 1:
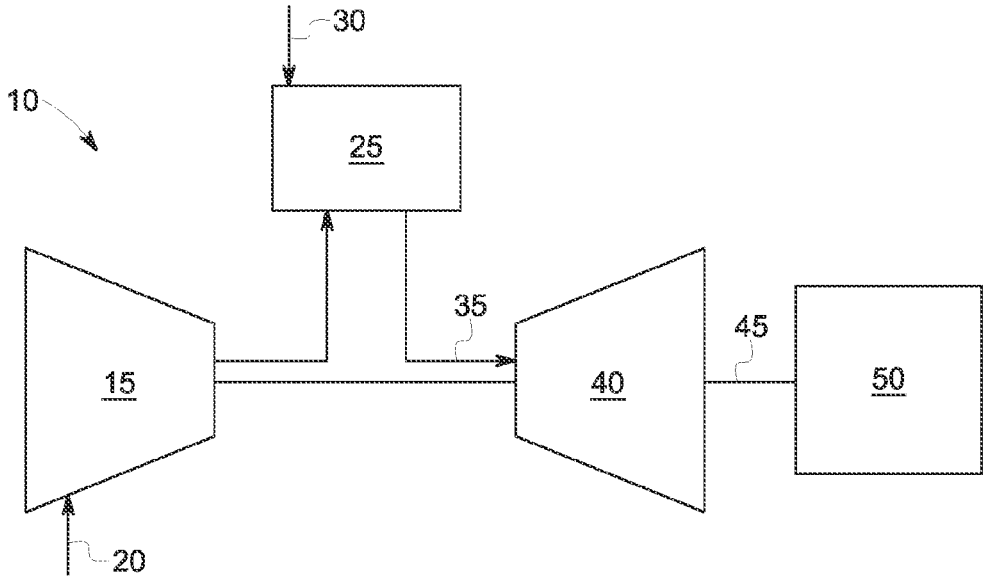
FIG. 1 (PRIOR ART)
FIG. 1 is a schematic of an example diagram of a gas turbine engine with a compressor, a combustor, and a turbine, according to an embodiment.

Illustrative embodiments are directed to, among other things, a combustor assembly including a trapped vortex cavity. FIG. 1 shows a schematic view of a gas turbine engine 10 as may be used herein. As is known, the gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components.

Other types of gas turbine engines also may be used herein. Multiple gas turbine engines, other types of turbines, and other types of power generation equipment also may be used herein together.

Figure 2:
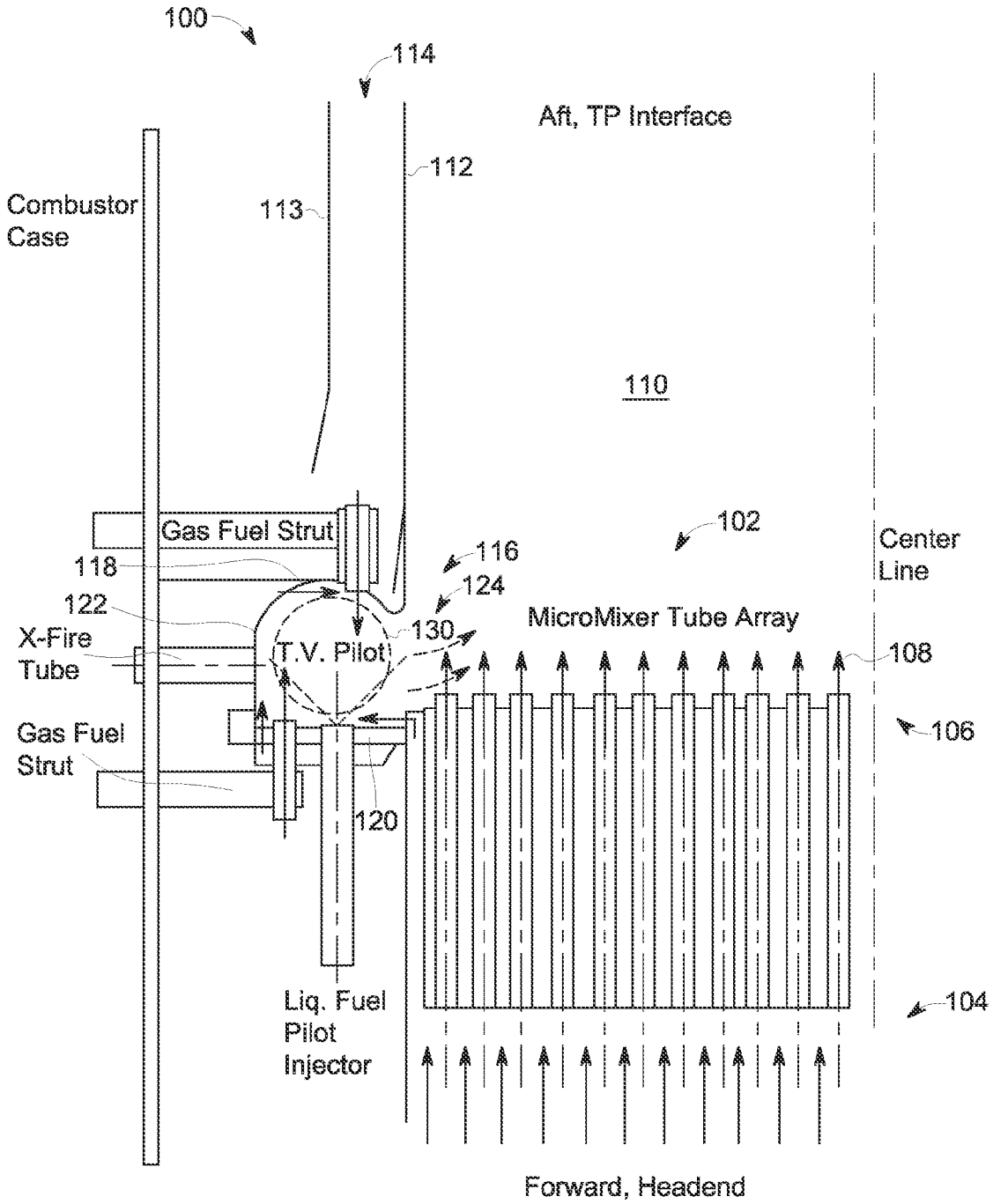
FIG. 2 is a schematic of a combustor assembly, according to an embodiment.

FIG. 2 depicts a component of the combustor 25 in FIG. 1; specifically, a micromixer 100 or a portion thereof. The micromixer 100 may include a bundle of air/fuel premixing injection tubes 102. The bundle of air/fuel premixing injection tubes 102 may include an upstream end 104, a downstream end 106, and a flow path 108 therebetween. The combustor may also include a combustion chamber 110 disposed downstream of the bundle of air/fuel premixing injection tubes 102. The combustion chamber 110 may be formed by an annular combustor liner 112. The annular combustion liner 112 may be surrounded, at least partially, by a flow sleeve 113. The annular combustion liner 112 and the flow sleeve 113 may form an air flow passage 114 in communication with the bundle of premixing tubes 102 and other components of the combustor, such as, an annular trapped vortex cavity, one or more air injection holes, or one or more fuel sources, all of which are discussed below.

Figure 3:
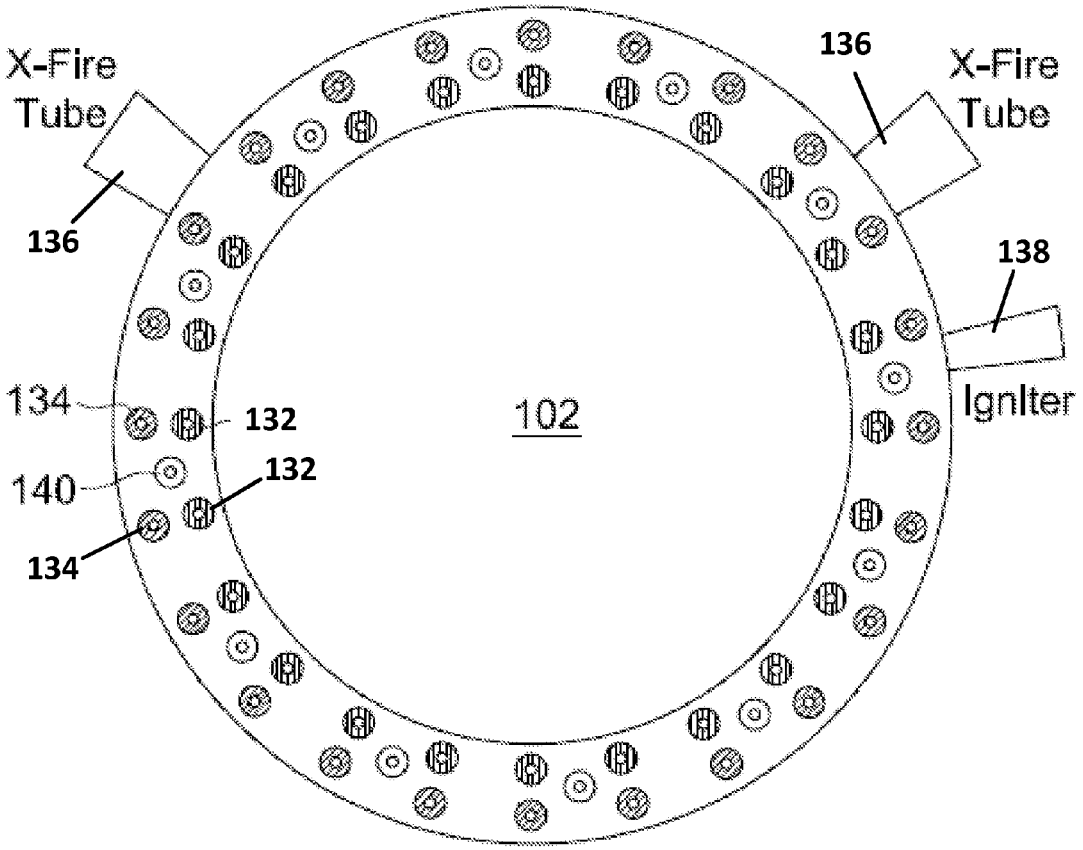
FIG. 3 is a cross-sectional view of a portion of a combustor assembly, according to an embodiment.

As depicted in FIGS. 2 and 3, an annular trapped vortex cavity 116 may be located about and adjacent to the downstream end 106 of the air/fuel premixing injection tubes 102. The annular trapped vortex cavity 116 may include an annular aft wall 118, an annular forward wall 120, and an annular radially outer wall 122 formed therebetween. One will appreciate, however, that annular aft wall 118, an annular forward wall 120, and an annular radially outer wall 122 may be integral such that the annular trapped vortex cavity 116 is one continuous structure. The annular trapped vortex cavity 116 may also include an opening 124 at a radially inner portion of the annular trapped vortex cavity 116 spaced apart from the outer wall 122 and extending between the aft wall 118 and the forward wall 120.

Figure 4:
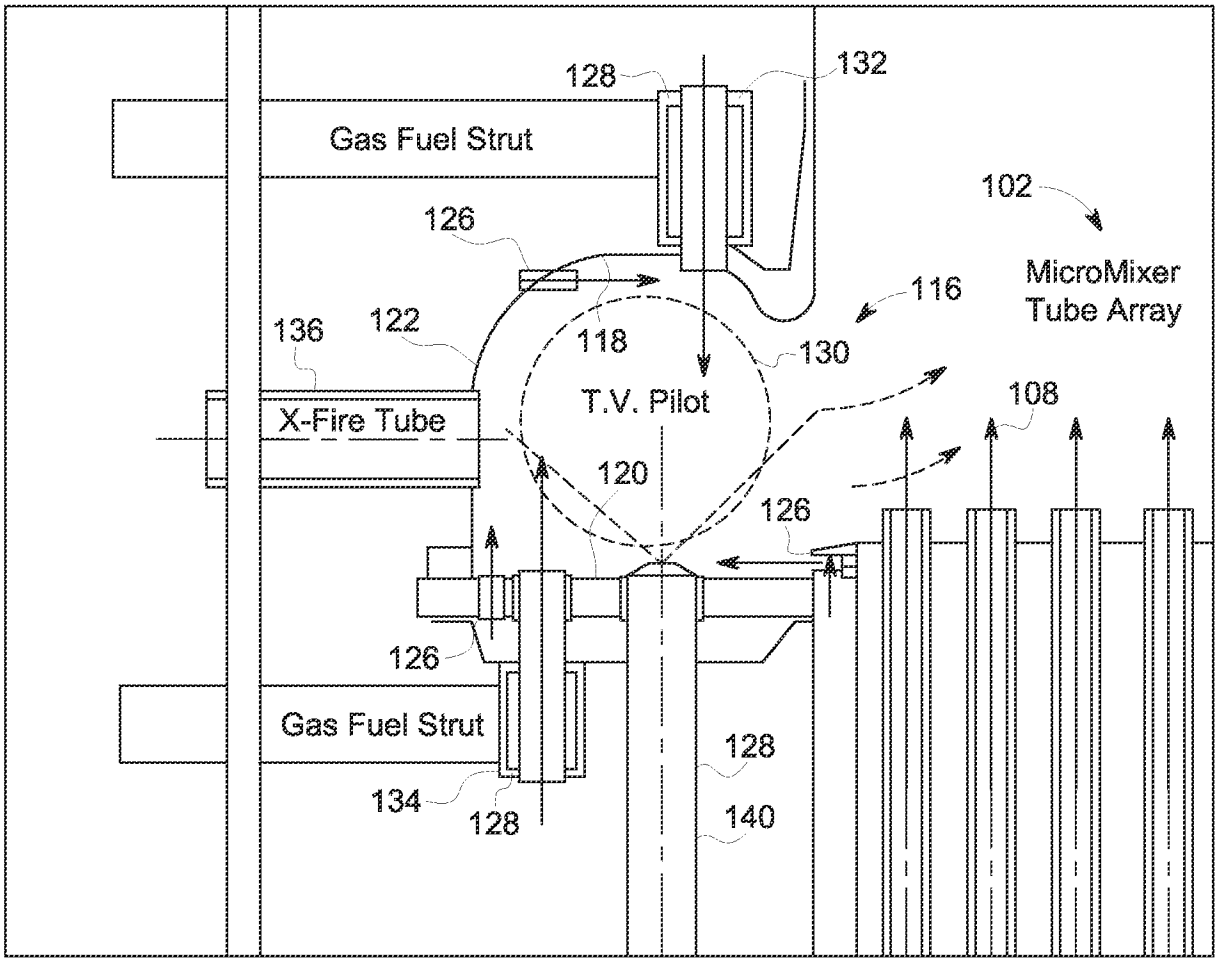
FIG. 4 is a schematic of a combustor assembly, according to an embodiment.
Figure 5:
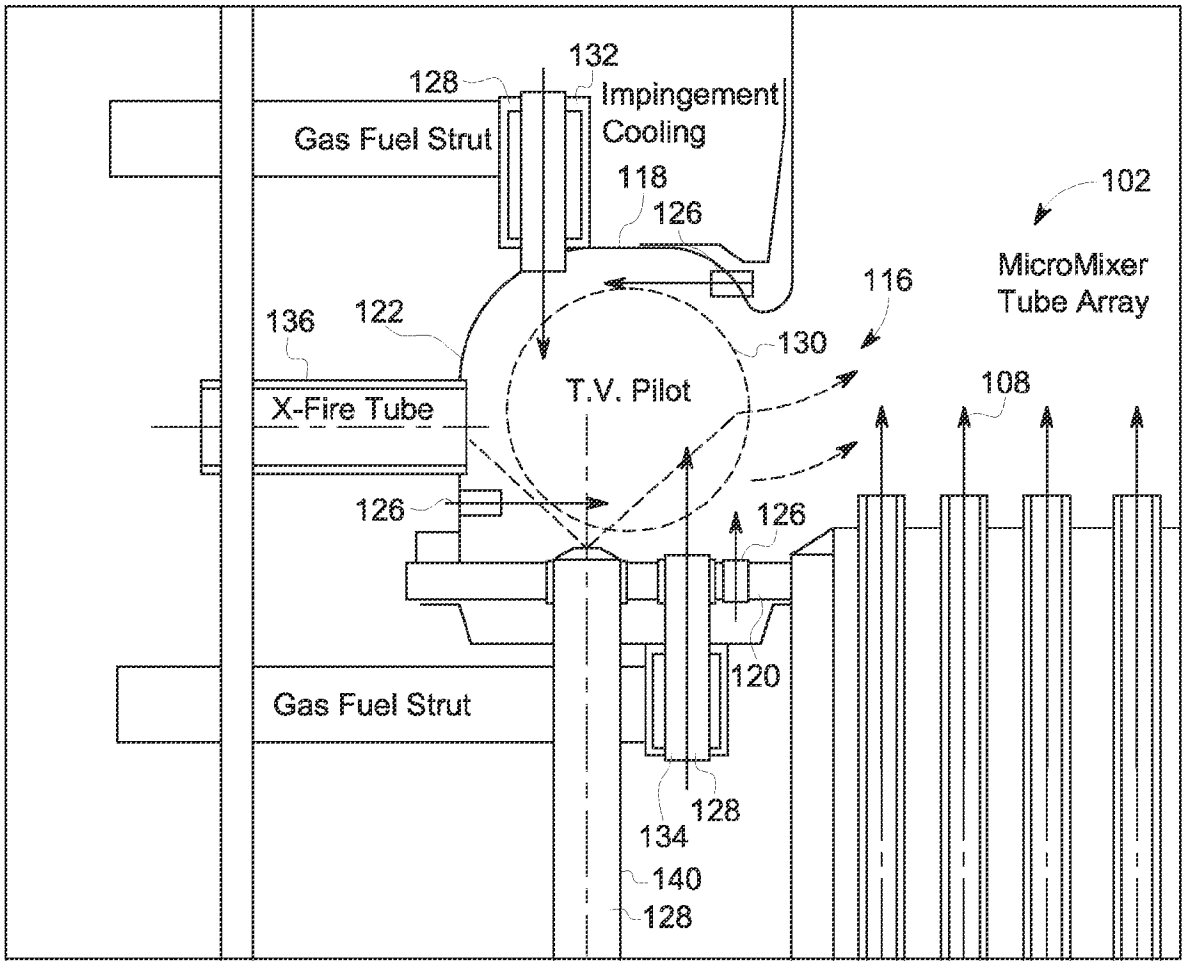
FIG. 5 is a schematic of a combustor assembly, according to an embodiment.

As depicted in FIGS. 4 and 5, one or more air injection holes 126 and one or more fuel sources 128 may be disposed about the annular trapped vortex cavity 116. The air injection holes 126 and the fuel sources 128 may be configured to drive a vortex 130 within the annular trapped vortex cavity 116. For example, in an embodiment, as depicted in FIG. 4, the air injection holes 126 and the fuel sources 128 may be located and/or angled to drive the vortex 130 within the annular trapped vortex cavity 116 in counter-rotation with the flow path 108 of the bundle of premixing tubes 102. In another embodiment, as depicted in FIG. 5, the air injection holes 126 and the fuel sources 128 may be located and/or angled to drive the vortex 130 within the annular trapped vortex cavity 116 in co-rotation with the flow path 108 of the premixing tubes 102. The number and position of air injection holes 126 and fuel sources 128 may vary depending on the rotation of the vortex 130 and the amount of air and fuel desired within the vortex.

As depicted in FIG. 4, the fuel sources 128 may include a first air/fuel premixing injection tube 132 disposed at a radially inner portion on the aft wall 118 in an upstream direction and a second air/fuel premixing injection tube 134 disposed at a radially outer portion on the forward wall 120 in a downstream direction. In this configuration, the first and second air/fuel premixing injection tubes 132 and 134 drive the vortex 130 within the annular trapped vortex cavity 116 in counter-rotation to the flow path 108 of the bundle of air/fuel premixing injection tubes 102. Also in this configuration, the air injection holes 126 are angled on the aft 118, forward 120, and/or radial wall 122 of the annular trapped vortex cavity 116 to further drive the vortex 130 within the annular trapped vortex cavity 116 in counter-rotation with the flow path 108 of the bundle of air/fuel premixing injection tubes 102.

As depicted in FIG. 5, the fuel sources 128 may include a first air/fuel premixing injection tube 132 disposed at a radially outer portion on the aft wall 118 in an upstream direction and a second air/fuel premixing injection tube 134 disposed at a radially inner portion on the forward wall 120 in a downstream direction. In this configuration, the first and second air/fuel premixing injection tubes 132 and 134 drive the vortex 130 within the annular trapped vortex cavity 116 in co-rotation with the flow path 108 of the bundle of air/fuel premixing injection tubes 102. Also in this configuration, the air injection holes 126 are angled on the aft 118, forward 120, and/or radial wall 122 of the annular trapped vortex cavity 116 to further drive the vortex 130 within the annular trapped vortex cavity 116 in co-rotation with the flow path 108 of the bundle of air/fuel premixing injection tubes 102.

In certain embodiments, the annular trapped vortex cavity 116 may be in communication with a crossfire tube 136. The crossfire 136 tube may provide an ignition source to the annular trapped vortex cavity 116. The crossfire 136 tube may be in communication with one or more annular trapped vortex cavities within the combustor. In other embodiments, the annular trapped vortex cavity 116 may be in communication with an igniter 138. In yet other embodiments, the annular trapped vortex cavity 116 may be in communication with both the crossfire 136 tube and the igniter 138.

In certain embodiments, the fuel sources 128 may include a liquid fuel injector 140. For example, as depicted in FIGS. 3-5, the annular trapped vortex cavity 116 may include at least one liquid fuel injector 140. The liquid fuel injector may be positioned on the forward wall 120 of the annular trapped vortex cavity 116 and in a downstream direction. One will appreciate, however, that any number of liquid fuel injectors may be positioned about the annular trapped vortex cavity in any direction. In some aspects, the liquid fuel injector is an atomizer injector.

In operation, air enters the combustor assembly via the air flow path 114 formed between the annular combustion liner 112 and the flow sleeve 113. A portion of the air is directed into the bundle of air/fuel premixing injection tubes 102 where it is mixed with a fuel. A portion of the air is also directed into the air injection holes 126 where it drives a vortex 130 in the annular trapped vortex cavity 116. Moreover, a portion of the air is directed into the air/fuel premixing injection tubes 134 and 136 where it is mixed with a fuel within the tube before entering the annular trapped vortex cavity 116 to further drive the vortex 130. As discussed above, the vortex 130 may rotate in a co- or counter-rotation with regard to the air/fuel jet exiting the bundle of air/fuel premixing injection tubes 102 into the combustion chamber 110. In some embodiments, the annular trapped vortex cavity 116 may further include a liquid fuel injector 140, a crossfire tube 136, and/or an igniter 138.

The annular trapped vortex cavity uses a portion of the overall combustion air and a portion of the overall combustion fuel (liquid or gas) to drive a trapped toroidal vortex having co- or counter-rotation with respect to the bundle of air/fuel premixing tubes jet flow path. The annular trapped vortex cavity acts as an annular pilot for the bundle of air/fuel premixing tubes combustion by supplying a stable source of fresh, hot combustion products and radicals to the bundle of air/fuel premixing tubes jet flames. As the annular trapped vortex cavity is a pilot zone, a relatively small amount of the total combustor fuel and air is used, e.g., 10% during operation.

The fuel and air enters the cavity via the micromixer premixing injector jets to drive the vortex. The gas-fuel reactants are premixed and injected as micromixer tubes, or, for the liquid fuel case, injected separately making a diffusion burning zone. The annular trapped vortex cavity reactants can be burned in a lean, rich, or neutral mode (relative to the main bundle of air/fuel premixing tube combustion zone. A lean mode may be used to produce less NOx emission and less stability at loaded conditions. A rich, or neutral mode, may provide greater stability for the main combustion at non- or low-load conditions. The annular trapped vortex cavity also acts as an ignition and/or cross-fire zone for starting the combustor on gas or liquid fuel.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A combustor assembly, comprising:

an annular trapped vortex cavity located adjacent to a downstream end of a bundle of air/fuel premixing injection tubes;

the annular trapped vortex cavity comprising an opening at a radially inner portion adjacent to a head end of the bundle of premixing tubes;

one or more air injection holes disposed about the annular trapped vortex cavity;

one or more fuel sources disposed about the annular trapped vortex cavity, wherein the one or more fuel sources comprise:

at least one air/fuel premixing injection tube disposed on an annular aft wall of the annular trapped vortex cavity; and at least one air/fuel premixing injection tube disposed on a forward wall of the annular trapped vortex cavity; and wherein the one or more air injection holes and the one or more fuel sources are configured to drive a vortex within the annular trapped vortex cavity.

2. The combustor assembly of claim 1, wherein the one or more fuel sources comprise one or more liquid fuel injectors.

3. The combustor assembly of claim 1, further comprising:

a cross fire tube or igniter in communication with the annular trapped vortex cavity.

4. A combustor assembly, comprising:

a bundle of air/fuel premixing injection tubes having an upstream end, a downstream end, and a flow path therebetween;

an annular trapped vortex cavity located adjacent to the downstream end of the air/fuel premixing injection tubes and defined between an annular aft wall, an annular forward wall, and an annular radially outer wall formed therebetween;

an annular trapped vortex cavity opening at a radially inner portion of the annular trapped vortex cavity spaced apart from the outer wall and extending between the aft wall and the forward wall;

one or more air injection holes disposed about the annular trapped vortex cavity;

one or more fuel sources disposed about the annular trapped vortex cavity, wherein the one or more fuel sources comprise:

a first air/fuel premixing injection tube disposed at a radially outer portion on the aft wall in an upstream direction; and a second air/fuel premixing injection tube disposed at a radially inner portion on the forward wall in a downstream direction; and wherein the one or more air injection holes and the one or more fuel sources are configured to drive a vortex within the annular trapped vortex cavity, wherein the first and second air/fuel premixing injection tubes drive the vortex within the annular trapped vortex cavity in co-rotation with the flow path of the bundle of air/fuel premixing injection tubes.

5. The combustor assembly of claim 4, wherein the one or more air injection holes are angled to drive the vortex within the annular trapped vortex cavity in co-rotation with the flow path of the premixing tubes.

6. The combustor assembly of claim 4, further comprising:

a crossfire tube in communication with the annular trapped vortex cavity.

7. The combustor assembly of claim 4, further comprising:

an igniter in communication with the annular trapped vortex cavity.

8. The combustor assembly of claim 4, wherein the one or more fuel sources comprises:

a liquid fuel injector positioned in a downstream direction.

9. A combustor assembly, comprising:

a bundle of air/fuel premixing injection tubes having an upstream end, a downstream end, and a flow path therebetween;

an annular trapped vortex cavity located adjacent to the downstream end of the air/fuel premixing injection tubes and defined between an annular aft wall, an annular forward wall, and an annular radially outer wall formed therebetween;

an annular trapped vortex cavity opening at a radially inner portion of the annular trapped vortex cavity spaced apart from the outer wall and extending between the aft wall and the forward wall;

one or more air injection holes disposed about the annular trapped vortex cavity;

one or more fuel sources disposed about the annular trapped vortex cavity, wherein the one or more fuel sources comprises:

a first air/fuel premixing injection tube disposed at a radially inner portion on the aft wall in an upstream direction; and a second air/fuel premixing injection tube disposed at a radially outer portion on the forward wall in a downstream direction;

a combustion chamber surrounded by an annular combustor liner disposed in air flow communication with the bundle of premixing tubes, the annular trapped vortex cavity, the one or more air injection holes, and the one or more fuel sources; and wherein the one or more air injection holes and the one or more fuel sources are configured to drive a vortex within the annular trapped vortex cavity, wherein the first and second premixer fuel injectors drive the vortex within the annular trapped vortex cavity in counter-rotation to the flow path of the bundle of air/fuel premixing injection tubes.

10. The combustor assembly of claim 9, wherein the one or more air injection holes are angled to drive the vortex within the annular trapped vortex cavity in counter-rotation to the flow path of the premixing tubes.

11. The combustor assembly of claim 9, further comprising:

a cross fire tube in communication with the annular trapped vortex cavity.

12. The combustor assembly of claim 9, further comprising:

an igniter in communication with the annular trapped vortex cavity.

13. The combustor assembly of claim 9, wherein the one or more fuel sources comprises:

a liquid fuel injector positioned in a downstream direction.

* * * * *